US005526886A

United States Patent [19]

Jenne

[11] Patent Number: 5,526,886

[45] Date of Patent: Jun. 18, 1996

[54] RAM BORING DEVICE

[75] Inventor: Dietmar Jenne, Strengelbach, Switzerland

[73] Assignee: Terra AG fuer Tiefbautechnik, Strengelbach, Switzerland

[21] Appl. No.: 216,489

[22] Filed: Mar. 22, 1994

[30] Foreign Application Priority Data

Mar. 23, 1993 [DE] Germany ..... 43 09 387.6

[51] Int. Cl.[6] ..... E21B 47/024

[52] U.S. Cl. ..... 175/45; 175/62; 175/106; 175/203; 340/856.1

[58] Field of Search ..... 175/19, 45, 56, 175/62, 106, 203; 340/856.1

[56] References Cited

U.S. PATENT DOCUMENTS

| | | | |
|---|---|---|---|
| 3,718,930 | 2/1973 | McCullough et al. | 340/856.1 X |
| 3,746,106 | 7/1973 | McCullough et al. | 175/45 |
| 4,621,698 | 11/1986 | Pittard et al. | 175/19 X |
| 4,632,191 | 12/1986 | McDounald et al. | 175/19 |
| 4,653,594 | 3/1987 | Yamamoto et al. | 175/55 X |
| 4,854,398 | 8/1989 | Holloway | 175/45 |
| 4,907,658 | 3/1990 | Stangl et al. | 175/45 X |
| 4,921,055 | 5/1990 | Kayes | 175/45 |
| 4,936,708 | 6/1990 | Perry | 405/184 |
| 5,010,965 | 4/1991 | Schmelzer | 175/19 |
| 5,182,516 | 1/1993 | Ward et al. | 324/326 |
| 5,234,061 | 8/1993 | Hesse | 175/19 |
| 5,322,391 | 6/1994 | Fisk | 175/19 X |

FOREIGN PATENT DOCUMENTS

| | | |
|---|---|---|
| 0357314 | 3/1990 | European Pat. Off. . |
| 3900122 | 7/1990 | Germany . |

*Primary Examiner*—Roger J. Schoeppel
*Attorney, Agent, or Firm*—McCormick, Paulding & Huber

[57] ABSTRACT

In a ram boring device with a essentially cylindrical ram housing (10) receiving the ram apparatus, and a displacement head (22) connected with one longitudinal end of the ram housing (10) and whose diameter at its end facing the ram housing (10) has a diameter at least equal to that of the ram housing (10), the ram boring device having a receiving space (24) for a position transmitter (28), a transmitter housing (20) containing the receiving space (24) is arranged between the displacement head (22) and the ram housing (20) with the transmitter housing (20) having an outer diameter at least nearly equal to the outer diameter of the ram housing (10).

7 Claims, 2 Drawing Sheets

RAM BORING DEVICE

FIELD OF THE INVENTION

The invention concerns a ram boring device with an essentially cylindrical ram housing receiving the ram apparatus and a displacement head, which displacement head is connected with one longitudinal end of the ram housing and the diameter of which displacement head at its end facing the ram housing is at least equal to the diameter of the ram housing, the ram boring device having a receiving space for a position transmitter.

BACKGROUND OF THE INVENTION

A ram boring device is known from EP-A- 0 361 805 equal to U.S. Pat. No. 4,907,658 as well as from DE-A- 39 00 122 in which the receiving room for the position transmitter is arranged in the region of the tip of the displacement head. This transmitter makes it possible to follow the actual progress of the earth displacement boring since the position as well as the depth of the ram boring device can be ascertained with the help of the position transmitter. Thus earth displacement boring can be carried out under difficult conditions over or under and past crossing conductors without the upper surface of the earth in the vicinity of the crossing conductors having to be dug up.

The arrangement of the position transmitter at the forwardmost part of the displacement head has the advantage that the position of the point of the ram boring apparatus can be ascertained. An essential drawback of this known arrangement, however, lies in that the position transmitter can only be poorly protected against the dynamic impacts of the ram apparatus. Therefore the transmitter has only a very limited service life. It must frequently be replaced already after a few earth borings. Since when a defect of the transmitter occurs it generally appears during an earth boring operation under the load of the impacts of the ram apparatus, the involved earth boring operation frequently cannot reliably be carried through to its end.

A further disadvantage of the known construction resides in that because of the necessary relative small outer diameter of the displacement head in its forward region the strength of the wall surrounding the transmitter is relatively low. Accordingly the longitudinal slots in the chisel nose or point of the displacement head must be relatively Small to assure a sufficient rigidity of the chisel point or of the displacement head. Because of the small slots, however, up to seventy percent (70%) of the transmission output is lost. This limits considerably the depth to which the ram boring device can be reliably placed.

Finally, the construction according to DE-A- 3 900 122, for example, has also the disadvantage that the transmitter is inserted into a bore extending inwardly from the front of the chisel point. The closure element closing this bore is in direct contact with the earth and is exposed to stones and similar impediments. Above all, in the destruction of impediments the closure element is extraordinarily strained and can easily be damaged.

SUMMARY OF THE INVENTION

The invention has as its object the provision of a ram boring device of the aforementioned kind which on one hand makes possible a reliable position finding of the ram boring device and in which on the other hand the transmitter is sufficiently protectable against mechanical stresses and therefore has a longer service life, as is possible in the case of customary devices.

This object is solved in accordance with the invention in that a transmitter housing containing the receiving space is arranged between the displacement head and the ram housing, the outer diameter of which transmitter housing is at least nearly equal to the outer diameter of the ram housing.

On one hand the transmitter housing and therewith also the transmitter, in the case of the inventive solution is sufficiently arranged so far forwardly as to be able to reliably report the position of the point of the ram boring device. On the other hand the arrangement of the transmitter housing between the displacement head and the ram housing offers the possibility of forming the receiving space for the transmitter so large that the transmitter can be reliably protected by means of suitable dampening elements against axial and radial vibrations and impacts. At the same time there still remains sufficient radial space to provide a strong wall around the transmitter housing which withstands all the mechanical stresses of a normal ram operation. Finally, because of the relatively large diameter of the transmitter housing numerous relatively wide slots can be provided for the escape of the transmitted electromagnetic waves without the transmitter housing being mechanically weakened in unreliable ways. Thereby in comparison to customary devices essentially larger portions of the transmission can be radiated which makes possible a reliable position finding of the ram boring device at greater depths. Since the entire displacement head lies in front of the transmission housing damaging of the transmission housing by impacts from the front is avoided when the ram boring device encounters hard impediments which are to be destroyed.

The displacement head is in general releasably connected with the ram housing, for example by being threaded onto the ram housing. This offers at the same time a convenient possibility for replacing the transmitter when required. The transmission housing can be made as one piece with the displacement head, so that it is removed together with the displacement head from the ram housing. The transmission housing can, however, also alternatively be made as a part separate from the displacement head and from the ram housing. The receiving space inside of the transmission housing is of such large measurements that the transmitter can be surrounded by dampening elements which protect it against axial and radial jolts, vibrations and impacts. As dampening elements steel springs or rubber and plastic dampeners, for example, come into question. The associated dampening elements must be suited to the prevailing application. According to another variation as dampening elements a special felt or water durable wadding is used. This dampening material has the advantage that because of its physical properties it also provides reliable dampening in the case of different strong vibratory loads.

The receiving space for the transmitter is connected with the outer circumferencial surface of the transmitter housing in a way known by itself through radial and axially extending slots so that the transmitter output can be radiated. Since because of the relatively large diameter of the transmitter housing the wall strength of the transmitter housing can be made relatively high, the slots can also be made wide without impairing the stability of the transmitter housing.

Advantageous developments of the invention are given in the further dependent claims.

BRIEF DESCRIPTION OF THE DRAWINGS

Further features and advantages of the invention will be apparent from the following description, which in combination with the accompanying drawings explain the invention with respect to exemplary embodiments. The drawings are.

DETAILED DESCRIPTION OF THE PREFERRED EMBODIMENTS

Figure 1:
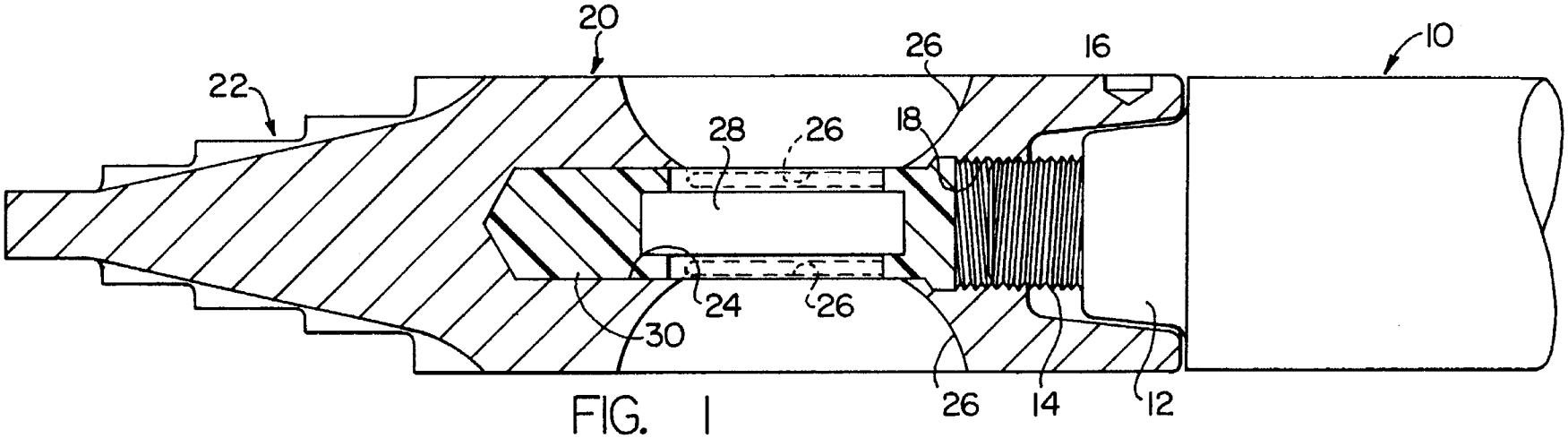
FIG. 1—a partially schematic partial sectional view containing the axis taken through the forward end of a ram boring device according to a first embodiment of the invention, FIG. 2—a section through the displacement head and the transmitter housing according to a second embodiment of the invention, and FIG. 3—a section containing the axis taken through the displacement head and the transmitter housing according to a third embodiment of the invention.

In FIG. 1 only the forward section of a ram boring device is illustrated. One can recognize the schematically presented forward end of a ram housing 10, in which the ram apparatus is arranged. The ram apparatus and the ram housing are for example made in the way described in the previously mentioned publications. The ram apparatus is therefore not explained in greater detail.

The ram housing 10 has at its forward end a conical shoulder 12 with an axially directed threaded stud 14. The conical shoulder 12 and the threaded stud 14 are received in a complementary recess 16 and threaded bore 18 in the rearward end of a transmitter housing 20 which is formed as one piece with the displacement head 22. Inside the transmitter housing is a cylindrical bore 24 which is connected with the outer circumferencial surface of the cylindrical transmitter housing 20 by means of slots 26 directed parallel to the axis. The bore 24 serves to receive a schematically illustrated transmitter 28, with the help of which the position of the ram boring device can be ascertained in a way known by itself.

As can be seen, the diameter of the transmitter housing 20 is equal to the largest diameter of the displacement head 22 at its rear end facing the ram housing 10. This permits, on one hand, the bore 24 to be made so wide that the transmitter 28 can be protected by suitable dampening elements 30 in the axial direction as well as in the radial direction against vibrations and impacts. On the other hand, because of the large diameter of the transmission housing 20 the wall surrounding the bore 24 can be made sufficiently strong to assure the required rigidity of the transmitter housing 20, despite the slots 26 in the wall, since this wall must transmit the entire impact energy of the ram device to the displacement head 22.

The dampening elements 30 can be made as elastically springy elements of steel, rubber or plastic. The elastic properties of the material used and the measurements of the dampening elements must be so chosen that at the given impact frequency of the ram apparatus an optimal dampening occurs. In place of such elastically springy elements, however, felt or wadded types of materials can be used if they under the given conditions promise a favorable dampening.

As can be seen in FIG. 1 the slots 26 extend in the axial direction up to the closed forward end of the bore 24. This makes it possible, by the insertion of a screw driver or the like, to push the transmitter 24 rearwardly out of the bore 24. Therefore, following the unscrewing of the transmitter housing 20 from the ram housing 10 the transmitter 28 can easily be replaced if the need to do so arises.

Figure 2:
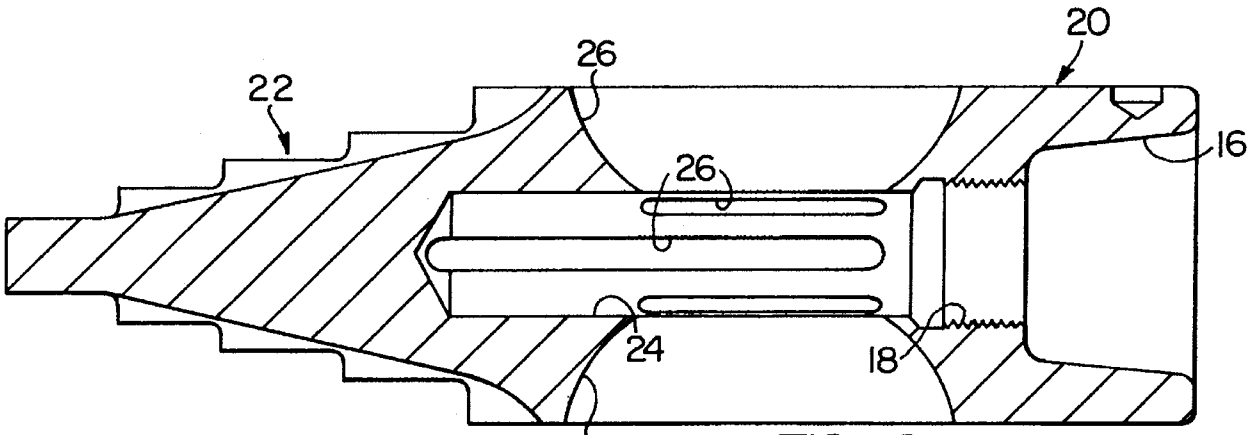

The embodiment according to FIG. 2 differs from the embodiment of FIG. 1 solely by way of a shorter axial construction length in which the bore 24 extends by a trivial amount into the displacement head 22.

Figure 3:
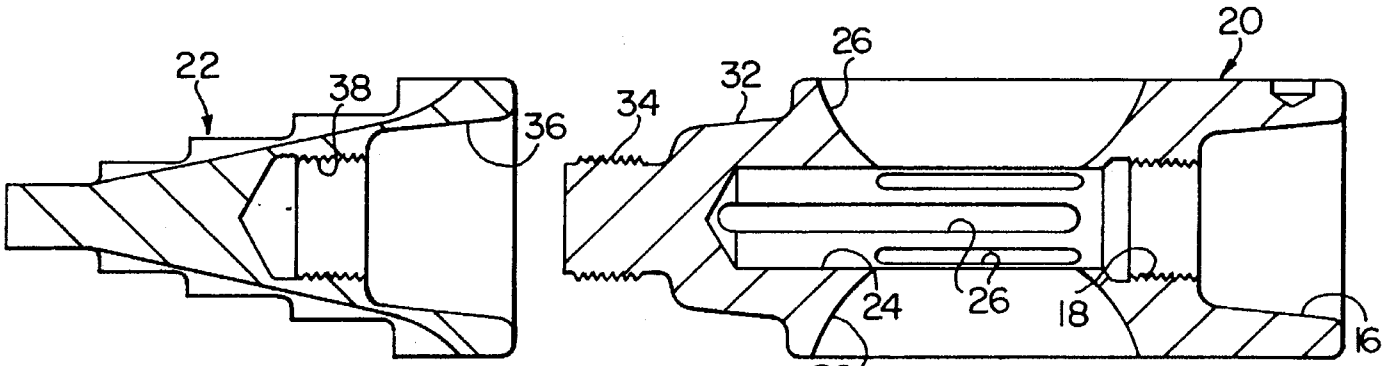

In the embodiment according to FIG. 3 the transmitter housing 20 is made as a separate part from the displacement head 22 and from the ram housing 10. The transmitter housing 20 and displacement head 22 are connected with one another in the same way as is the transmitter housing 20 with the ram housing 10, by means of a conical shoulder 32 and a threaded stud 34 on the transmitter housing and a conical recess 36 and threaded bore 38 in the displacement head 22.

The previous description illustrates that with the solution of the invention the transmitter can be arranged with sufficient mechanical protection at a favorable location—that is, near the forward end of the ram boring device. Sufficient space stands at one's disposal to sufficiently mechanically protect and/or to accommodate a robust transmitter which in general requires a large space.

I claim:

1. A ram boring device with a generally cylindrical ram housing (10) containing a ram apparatus, and a displacement head (22) which is connected with one longitudinal end of the ram housing (10) and whose diameter on its end facing the ram housing (10) is at least equal to the diameter of the ram housing (10), the ram boring device having a receiving space (24) for a position transmitter (28), characterized in that a transmitter housing (20) containing the receiving space (24), the outer diameter of which transmitter housing (20) is at least nearly equal to the outer diameter of the ram housing (10), is arranged between the displacement head (22) and the ram housing (10), and in that said transmitter housing (20) is of essentially cylindrical shape and has Cylindrical axial bore (22) with an internal cylindrical surface for receiving the position transmitter (28), said transmitter has two opposite ends and an external cylindrical surface extending between said two opposite ends, the axial length of said transmitter being considerably shorter than the axial length of said axial bore and the diameter of said external cylindrical surface of said transmitter being considerably smaller than the diameter of said internal cylindrical surface of said bore so as to provide an annular space between said two cylindrical surfaces, and in that two dampening elements (30) are arranged in the bore (28) each at a respective one of said two opposite ends of said transmitter, each of said dampening elements having a first portion engaging the associated end of said transmitter and extending a substantial distance axially away from said associated and also having a second portion which second portion is of annular shape and extends into said annular space a substantial distance from said associated end of said transmitter toward the opposite one of said ends and which second portion engages both said internal cylindrical surface of said bore and said external cylindrical surface of said transmitter, so that said two dampening elements dampen the movements of the position transmitter (28) in the axial direction and in the radial direction relative to the transmitter housing (20).

2. A ram boring device according to claim 1 characterized in that the transmitter housing (20) is made as one piece with the displacement head (22).

3. A ram boring device according to claim 1 characterized in that the transmitter housing (20) is made as a part separate from the ram housing (10) and from the displacement head (22).

4. A ram boring device according to claim 1 characterized in that the dampening elements (30) consist of felt or water durable wadding.

5. A ram boring device according to claim 1 characterized in that said device has a longitudinally extending axis, that said transmitter housing (20) has an external circumferential surface generally concentric with said longitudinal axis, and that the bore (24) in the transmitter housing (20) is generally concentric with said longitudinal axis and is connected with said external circumferential surface of the transmitter housing (20) by a plurality of slots directed radially and parallel to said longitudinal axis.

6. A ram boring device according to claim 5 characterized in that the transmitter housing (20) has one closed end and at least one of the slots (26) is elongated up to at least nearly closed end of the bore (24).

7. A ram boring device according to claim 1 characterized in that the dampening elements (30) are made of elastically springy elements of steel, rubber or plastic.

* * * * *